US006647880B2

(12) United States Patent
Kolbe et al.

(10) Patent No.: US 6,647,880 B2
(45) Date of Patent: Nov. 18, 2003

(54) FLEXOGRAPHIC PRINTING PRESS WITH DEVICE FOR WASHING THE BACK-PRESSURE CYLINDER

(75) Inventors: Wilfried Kolbe, Gülzow (DE); Klaus Schirrich, Bielefeld (DE); Manfred Terstegen, Bielefeld (DE); Bodo Steinmeier, Bielefeld (DE); Lars Grüter, Steinhagen (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 09/977,571

(22) Filed: Oct. 15, 2001

(65) Prior Publication Data

US 2002/0073864 A1 Jun. 20, 2002

(30) Foreign Application Priority Data

Oct. 13, 2000 (EP) ..... 00122461

(51) Int. Cl.[7] ..... B41F 35/00
(52) U.S. Cl. ..... 101/424; 101/425
(58) Field of Search ..... 101/423–425; 15/256.51, 256.52; 399/350, 357

(56) References Cited

U.S. PATENT DOCUMENTS 3,378,902 A 4/1968 Hoexter ..... 492/4
5,189,956 A * 3/1993 Reder et al. ..... 101/364
5,367,982 A * 11/1994 DeMoore et al. ..... 118/46
5,740,739 A * 4/1998 Herold et al. ..... 101/425
5,768,993 A * 6/1998 Stuart ..... 101/366
5,787,811 A 8/1998 Achelpohl et al. ..... 101/349.1
5,816,163 A * 10/1998 Achelpohl et al. ..... 101/483
6,386,105 B1 * 5/2002 Stahl ..... 101/423

FOREIGN PATENT DOCUMENTS

| | | |
|---|---|---|
| EP | 0812681 | 12/1997 |
| EP | 0769373 | 1/1999 |
| EP | 0970810 | 1/2000 |
| EP | 1010522 | 6/2000 |
| EP | 1090754 | 4/2001 |

* cited by examiner

*Primary Examiner*—Anthony H. Nguyen
(74) *Attorney, Agent, or Firm*—Richard M. Goldberg

(57) ABSTRACT

A flexographic printing press with a back-pressure cylinder (10) and at least one inking unit (12, 14, 16), which has an exchangeable printing cylinder (20), which can be placed against the back-pressure cylinder (10), an engraved ink transfer cylinder (24; 38), which can be placed against the printing cylinder and a chamber doctor blade (26), which can be placed against engraved ink transfer cylinder, wherein a washing cylinder (34) is constructed to be inserted in the inking unit (12, 14, 16) instead of the printing cylinder (20) and to apply cleaning liquid to the surface of the back-pressure cylinder (10).

22 Claims, 2 Drawing Sheets

FLEXOGRAPHIC PRINTING PRESS WITH DEVICE FOR WASHING THE BACK-PRESSURE CYLINDER

BACKGROUND OF THE INVENTION

The invention relates to a flexographic printing press with a back-pressure cylinder and at least one inking unit, which has an exchangeable printing cylinder, which can be placed against the back-pressure cylinder, an engraved ink transfer cylinder, which can be placed against the printing cylinder and a chamber doctor blade, which can be placed against the engraved ink transfer cylinder.

In the case of such a printing press, the printing cylinders and, as a rule, also the engraved ink transfer cylinders of the various inking units can be exchanged, so that the machine can be re-equipped for different printing tasks. In EP-A-0 769 373, a flexographic printing press is described, for which a particularly simple exchange of printing cylinders is made possible owing to the fact that the actual printing cylinder is constructed as a so-called sleeve, which is disposed removably on an axle, which is held in the machine frame, and can be pulled off axially from this axle. U.S. Pat. No. 3,378,902 discloses a system, which permits the sleeve to be clamped hydraulically on the axle. Further examples of printing presses, for which the printing cylinder and the engraved ink transfer cylinder can be exchanged easily, are described in EP-A-0 812 681 and in EP-A-1 090 754. EP-A-1 010 522 discloses a robot, with which the exchange of cylinders can be automated.

In the case of conventional flexographic printing presses, the driving mechanisms for the back-pressure cylinder and the printing cylinder of the individual inking units are coupled mechanically with one another. On the other hand, EP-A-1 000 737 described a flexographic printing press with individual driving mechanisms, with which the rpm of the printing cylinders can be selected independently of the rpm of the back-pressure cylinder.

In the EP-A-0 970 810, a system is described for cleaning the engraved ink transfer cylinder and the chamber doctor blade. In this case, a system of pipelines, which is normally used to supply printing ink to the chamber doctor blade and to discharge excess printing ink from the chamber doctor blade, is employed for flushing the chamber doctor blade with a cleaning liquid. At the same time, the peripheral surface of the engraved ink transfer cylinder can also be cleaned.

Since contamination, which can affect the printing quality, accumulates also on the surface of the back-pressure cylinder during the course of the printing process, it is necessary to wash off the printing cylinder from time to time with a liquid solvent. Until now, this has been done manually in a relatively time-consuming and work-intensive manner.

SUMMARY OF THE INVENTION

It is an object of the invention to equip a flexographic printing press with a washing device, which facilitates the washing of the back-pressure cylinder.

Pursuant to the invention, this objective is accomplished by a washing cylinder, which is constructed to be inserted in one of the inking units instead of the printing cylinder and to apply cleaning fluid to the surface of the back-pressure cylinder.

Accordingly, since the washing cylinder takes the place of the printing cylinder in one of the inking units during the washing process, hardly any additional space is required at the periphery of the back-pressure cylinder for accommodating the washing device. By these means, a compact construction of the printing press becomes possible. A further advantage consists therein that the components of the washing device are present anyhow in the printing press. Accordingly, especially the driving mechanism, which is normally provided for the printing cylinder, can also be used as driving mechanism for the washing cylinder and the placement of the washing cylinder in contact with the back-pressure cylinder can also be brought about with the help of the mechanisms, which are otherwise used for the printing cylinder. In preparation for the washing process, the printing cylinder of one of the inking units must be exchanged for the washing cylinder. With the help of the devices, provided for exchanging printing cylinders, as described, for example, in the publications named above, this process can also be simplified or automated.

If the inking unit, into which the washing cylinder is to be installed, has a known device for flushing the chamber doctor blade with cleaning liquid, this chamber doctor blade and the engraved ink transfer cylinder can also be used for moistening the washing cylinder with cleaning liquid, so that additional devices for supplying cleaning liquid to the washing cylinder are not required. So that the washing cylinder is supplied with a sufficient amount of cleaning liquid, it may be appropriate for the washing process to exchange the engraved ink transfer cylinder, normally used for the printing presses, for a special engraved ink transfer cylinder, which is capable of transferring a larger amount of liquid.

The cleaning liquid, which is applied to the surface of the back-pressure cylinder, preferably is removed with the help of a doctor blade, which can be placed against and removed from the periphery of the back-pressure cylinder and is disposed in the vicinity of the lower apex of this cylinder, together with the contaminants, which have been stripped off from the back-pressure cylinder by means of this cleaning liquid. This doctor blade then represents the only component of the washing device, which must be disposed additionally at the periphery of the back-pressure cylinder.

The invention is particularly advantageous in the case of a flexographic printing press with individual driving mechanisms, since in that case the peripheral velocity, selected for the washing cylinder, can be different from that selected for the back-pressure cylinder, so that a wiping motion takes place at the contact area. Alternatively, the washing cylinder can also be driven in the opposite direction to the back-pressure cylinder for this purpose.

BRIEF DESCRIPTION OF THE DRAWINGS

In the following, an example of the invention is explained in greater detail by means of the drawing, in which.

DETAILED DESCRIPTION

Figure 1:
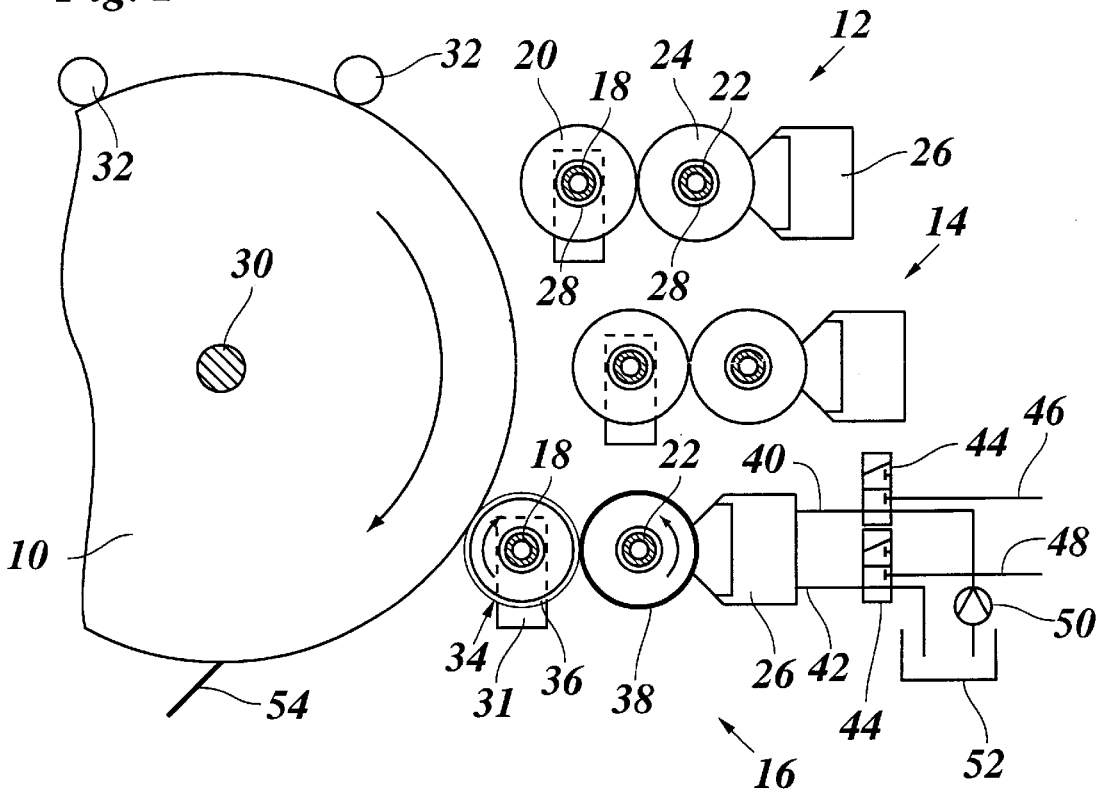
FIG. 1 shows a diagrammatic representation of a flexographic printing press with an inventive washing device.

In FIG. 1, a counter-pressure cylinder 10 as well as three inking units 12, 14, 16 of a flexographic printing press are shown diagrammatically. Three further inking units, which are not shown, are disposed on the opposite side of the back-pressure cylinder 10.

Each of the inking units 12, 14, 16 has a shaft 18 for a printing cylinder 20, a shaft 22 for an engraved ink transfer cylinder 24 and a chamber doctor blade 26. In the example shown, the printing cylinder 20 and the engraved ink transfer cylinder 24 are clamped removably with hydraulic bushings 28 on the associated shaft 18 or 22. The shaft 18, 22 of the individual inking units, as well as a shaft 30 of the back-pressure cylinder 10 can be driven independently of one another with individual driving mechanisms, of which only the driving mechanisms 31 of the shaft 18 of the individual inking units are shown. Furthermore, the shafts 18, 22 and the chamber doctor blade 26 can be removed with known but not shown switching-on and switching-off mechanisms in such a manner, that the printing cylinder 20 can be placed against the back-pressure cylinder 10, the engraved ink transfer cylinder 24 against the printing cylinder 20 and the chamber doctor blade 26 against engraved ink transfer cylinder 24.

During the printing operation, a web of material, which is to be printed but is not shown in FIG. 1, is passed with the help of guiding rollers 32 over the back-pressure cylinder 10 in such a manner, that it passes by all six inking units, and the printing cylinders 20 of all inking units are placed in contact with the back-pressure cylinder. Every chamber doctor blade 26 is filled with printing ink, which is supplied by an ink-supplying system, which is not shown. At their surface, the engraved ink transfer cylinders 24 have cell screens. On the passing through the chamber doctor blade 26, the cells are filled with printing ink and then deliver their printing ink to the printing parts of the block, which is clamped on the printing cylinder 20, so that the material to be printed is printed in each inking unit with the color separation in question.

FIG. 1 shows the printing press as the back-pressure cylinder 10 is being washed. In this state, the web of material, which is to be printed, is not passed over the back-pressure cylinder 10 and all inking units 12, 14, with the exception of inking unit 16, are removed from the back-pressure cylinder. In this state, the inking unit 16 is converted into a washing device. For this purpose, the printing cylinder 20 has been replaced by a washing cylinder 34, which has a surface layer 36 of a material, such as felt, sponge or the like, which is capable of absorbing liquid. Instead of the engraved ink transfer cylinder 24, which is used for the printing, a special engraved ink transfer cylinder 38 which, in comparison to the engraved ink transfer cylinder 24, can transfer a larger amount of liquid, is clamped on the shaft 22 for the inking unit 16.

As shown in FIG. 1 by the example of the inking unit 16, the chamber doctor blades 26 of all inking units can be connected over hoses 40, 42 and reversing valves 44 either with pipelines 46, 48 of an ink-supplying system or with a system for supplying cleaning liquid. The system for supplying cleaning liquid comprises a pump 50 and a container 52 for the cleaning liquid. This supplying system is employed by all inking units for flushing the chamber doctor blades 26 with cleaning liquid after a printing process and, at the same time, for cleaning the engraved ink transfer cylinder 24. During the washing operation, this system is used by the inking unit 16 for the purpose of impregnating the surface layer 36 of the washing cylinder 34 with cleaning liquid. With the help of a pump 50, cleaning liquid, such as a solvent, is pumped from the container 52 over the hose 40 into the chamber doctor blade 26, and excess cleaning liquid is returned once again over the hose 42 to the container 52. The cells on the surface of the engraved ink transfer cylinder 38 are filled with cleaning liquid as they pass through the chamber doctor blade 26 and then deliver the cleaning liquid to the surface layer 36 of the washing cylinder 34. From the washing cylinder 34, the cleaning liquid is then transferred to the surface of the back-pressure cylinder 10.

In the example shown, the back-pressure cylinder 10, as well as the washing cylinder 34, are driven clockwise, so that their surfaces move past one another in opposite directions. The surface layer 36 of the washing cylinder thus wipes over the surface of the back-pressure cylinder 10 and the dirt particles, adhering to the surface of the back-pressure cylinder, are detached with the help of the cleaning liquid and, at the same time, wiped away mechanically.

In the direction of rotation of the back-pressure cylinder 10, the washing cylinder 34 of the inking unit 16 is directly in front of the lower apex of this back-pressure cylinder. In the region of the lower apex, a doctor blade 54 is pushed pneumatically against the back-pressure cylinder, so that the cleaning liquid and the dirt particles are removed by the doctor blade from the surface of the back-pressure cylinder.

Figure 2:
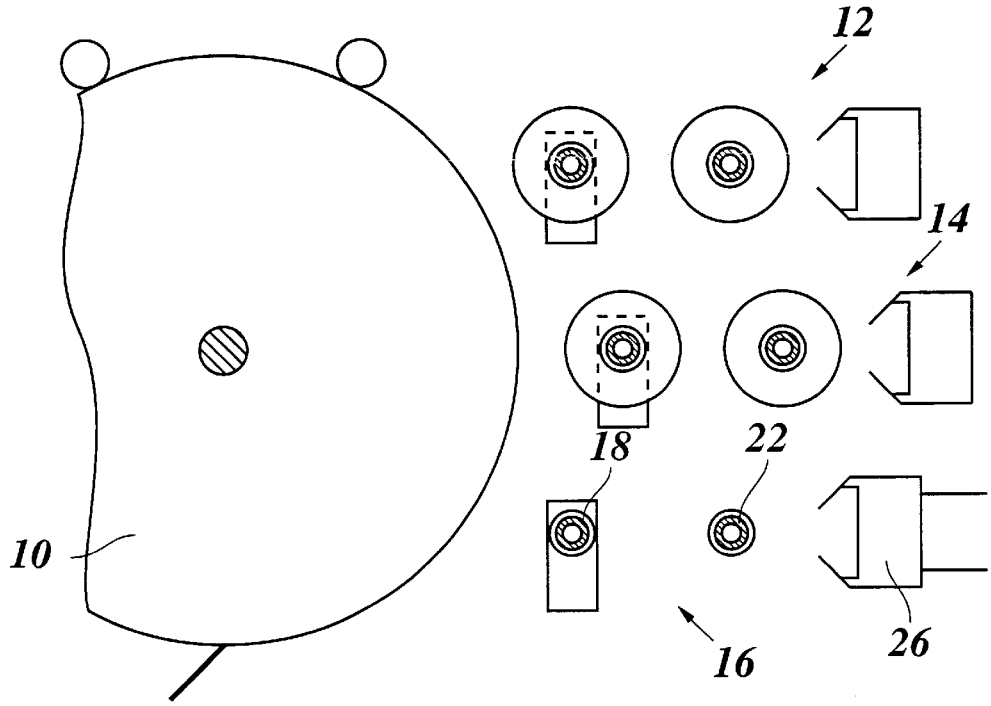
FIG. 2 shows the flexographic printing press of FIG. 1 during the changeover from the washing operation to the printing operation and FIG. 3 shows the flexographic printing press after the changeover to the printing operation.

When the washing process is concluded, the driving mechanisms for the back-pressure cylinder 10, the washing cylinder 34 and the engraved ink transfer cylinder 38 are stopped and the washing cylinder 34, the engraved ink transfer cylinder 38 and the chamber doctor blade 26 of the inking unit 16 are placed away from one another and from the back-pressure cylinder 10. Subsequently, the hydraulic bushings 28 are undone and the washing cylinder 34 and the engraved ink transfer cylinder 38 are pulled off from the associated shafts 18, 22. This condition is shown in FIG. 2.

Figure 3:
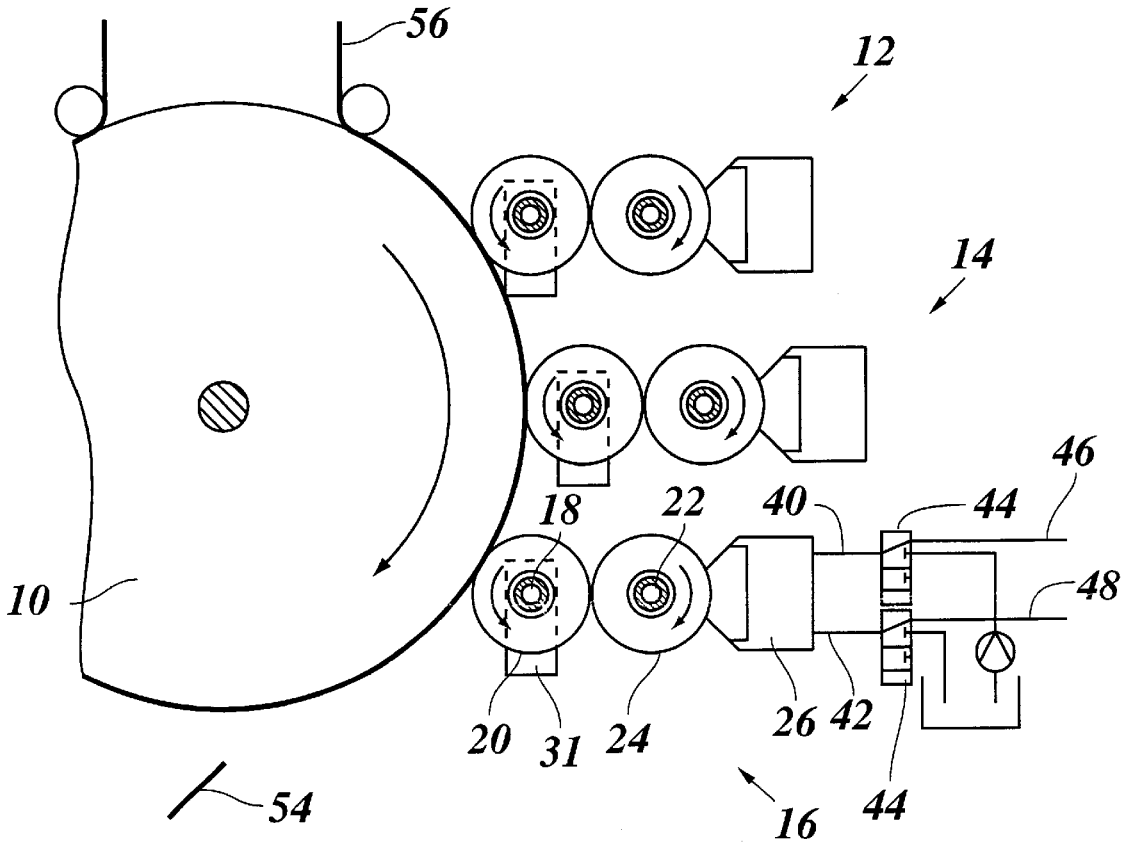

In preparation for the next printing process, a printing cylinder 20 and a conventional engraved ink transfer cylinder 24 are then clamped on the shafts 18, 22 of the inking unit 16, as shown in FIG. 3. The doctor blade 54 is removed from the back-pressure cylinder 10, a web of material 56, which is to be printed, is threaded in, the chamber doctor blade 26 of each inking unit is connected over the reversing valves 44 with the pipelines 46, 48 of the ink-supplying system and the inking units are placed in contact with the back-pressure cylinder 10, so that the printing process can commence. During the printing process, the printing cylinders 20 and the back-pressure cylinder 10 are driven in opposite directions, so that their printing surfaces roll without slipping over the material, which is to be printed.

What is claimed is:

1. A flexographic printing press comprising:

a back-pressure cylinder having a surface, and a first inking unit which includes:

an exchangeable printing cylinder arranged to be placed against the back-pressure cylinder, an engraved ink transfer cylinder arranged to be placed against the printing cylinder, a chamber doctor blade arranged to be placed against the engraved ink transfer cylinder, and a second inking unit including a washing cylinder inserted therein in place of a second printing cylinder and arranged to be placed against the back-pressure cylinder, to apply cleaning liquid to the surface of the back-pressure cylinder.

2. The flexographic printing press of claim 1, wherein a chamber doctor blade of the second inking unit which is provided for the washing cylinder, is connectable with a system for supplying cleaning liquid, so that, during a washing operation, the cleaning liquid is transferred over the chamber doctor blade and the engraved ink transfer cylinder of the second inking unit to the washing cylinder.

3. The flexographic printing press of claim 1, further comprising a doctor blade which is movable to be placed against a periphery of the back-pressure cylinder, to remove the cleaning liquid applied the washing cylinder.

4. The flexographic printing press of claim 3, wherein the doctor blade is placed against the back-pressure cylinder in the vicinity of a lower apex thereof.

5. The flexographic printing press of claim 1, wherein:

the back-pressure cylinder includes a lower apex and rotates in a first direction, said at least one inking unit includes several inking units located around the surface of the back-pressure cylinder, the washing cylinder is inserted into one said inking unit, and the washing cylinder is located at a position relative to the other inking units such that the inking unit which includes the washing cylinder is a last one of the inking cylinders in the first direction of rotation of the back-pressure cylinder before the lower apex of the back-pressure cylinder.

6. The flexographic printing press of claim 1, wherein the engraved ink transfer cylinder of the inking unit into which the washing cylinder is inserted, is exchanged for an engraved ink transfer cylinder which has a higher capability for transferring liquid than the removed engraved ink transfer cylinder.

7. The flexographic printing press of claim 1, wherein the printing cylinder and the washing cylinder are constructed as sleeves, each of which is disposed removably on an associated shaft and, when a cylinder is exchanged, is pulled off axially from this shaft.

8. The flexographic printing press of claim 1, further comprising a driving mechanism for the printing cylinder and the washing cylinder, the driving mechanism being an individual driving mechanism without any mechanical coupling to a driving mechanism of the back-pressure cylinder.

9. The flexographic printing press of claim 2, further comprising a doctor blade which is movable to be placed against a periphery of the back-pressure cylinder, to remove the cleaning liquid applied by the washing cylinder.

10. The flexographic printing press of claim 2, wherein:

the back-pressure cylinder includes a lower apex and rotates in a first direction, said at least one inking unit includes several inking units located around the surface of the back-pressure cylinder, the washing cylinder is inserted into one said inking unit, and the washing cylinder is located at a position relative to the other inking units such that the inking unit which includes the washing cylinder is a last one of the inking cylinders in the first direction of rotation of the back-pressure cylinder before the lower apex of the back-pressure cylinder.

11. The flexographic printing press of claim 3, wherein:

the back-pressure cylinder includes a lower apex and rotates in a first direction, said at least one inking unit includes several inking units located around the surface of the back-pressure cylinder, the washing cylinder is inserted into said second inking unit, and the washing cylinder is located at a position relative to the other inking units such that the second inking unit which includes the washing cylinder is a last one of the inking cylinders in the first direction of rotation of the back-pressure cylinder before the lower apex of the back-pressure cylinder.

12. The flexographic printing press of claim 2, wherein the engraved ink transfer cylinder of the inking unit into which the washing cylinder is inserted, is exchanged for an engraved ink transfer cylinder which has a higher capability for transferring liquid than the removed engraved ink transfer cylinder.

13. The flexographic printing press of claim 3, wherein the engraved ink transfer cylinder of the inking unit into which the washing cylinder is inserted, is exchanged for an engraved ink transfer cylinder which has a higher capability for transferring liquid than the removed engraved ink transfer cylinder.

14. The flexographic printing press of claim 4, wherein the engraved ink transfer cylinder of the inking unit into which the washing cylinder is inserted, is exchanged for an engraved ink transfer cylinder which has a higher capability for transferring liquid than the removed engraved ink transfer cylinder.

15. The flexographic printing press of claim 2, wherein the printing cylinder and the washing cylinder are constructed as sleeves, each of which is disposed removably on an associated shaft and, when a cylinder is exchanged, is pulled off axially from this shaft.

16. The flexographic printing press of claim 3, wherein the printing cylinder and the washing cylinder are constructed as sleeves, each of which is disposed removably on an associated shaft and, when a cylinder is exchanged, is pulled off axially from this shaft.

17. The flexographic printing press of claim 4, wherein the printing cylinder and the washing cylinder are constructed as sleeves, each of which is disposed removably on an associated shaft and, when a cylinder is exchanged, is pulled off axially from this shaft.

18. The flexographic printing press of claim 2, further comprising a driving mechanism for the printing cylinder and the washing cylinder, each the driving mechanism being an individual driving mechanism without any mechanical coupling to a driving mechanism of the back-pressure cylinder.

19. The flexographic printing press of claim 3, further comprising a driving mechanism for the printing cylinder and the washing cylinder, the driving mechanism being an individual driving mechanism without any mechanical coupling to a driving mechanism of the back-pressure cylinder.

20. The flexographic printing press of claim 4, further comprising a driving mechanism for the printing cylinder and the washing cylinder, the driving mechanism being an individual driving mechanism without any mechanical coupling to a driving mechanism of the back-pressure cylinder.

21. The flexographic printing press of claim 6, wherein said washing cylinder has a surface layer of a material which is capable of absorbing liquid.

22. The flexographic printing press of claim 21, wherein said surface layer is made from a material selected from the group consisting of a felt material and a sponge material.

* * * * *